US012320020B1

(12) United States Patent
Omran et al.

(10) Patent No.: US 12,320,020 B1
(45) Date of Patent: Jun. 3, 2025

(54) METHOD FOR ELECTROCHEMICAL OXIDATION OF METHANOL

(71) Applicant: IMAM MOHAMMAD IBN SAUD ISLAMIC UNIVERSITY, Riyadh (SA)

(72) Inventors: Mohamed Khairy Abdel Fattah Omran, Riyadh (SA); Mohamed Mokhtar Mohamed, Benha (EG); Salah Ahmed Ibrahim Eid, Sakaka (SA); Babiker Yagoub Elhadi Abdulkhair, Riyadh (SA)

(73) Assignee: IMAM MOHAMMAD IBN SAUD ISLAMIC UNIVERSITY, Riyadh (SA)

( * ) Notice: Subject to any disclaimer, the term of this patent is extended or adjusted under 35 U.S.C. 154(b) by 0 days.

(21) Appl. No.: 18/921,773

(22) Filed: Oct. 21, 2024

(51) Int. Cl.

| | |
|---|---|
| ***C25B 1/01*** | (2021.01) |
| ***C25B 1/02*** | (2006.01) |
| ***C25B 1/50*** | (2021.01) |
| ***C25B 11/077*** | (2021.01) |
| ***C25B 11/081*** | (2021.01) |

(52) U.S. Cl.
CPC ..... *C25B 11/077* (2021.01)

(58) Field of Classification Search
CPC ..... C25B 11/077; C25B 11/081; C25B 1/01; C25B 1/02; C25B 1/50
USPC ..... 205/555, 638
See application file for complete search history.

(56) References Cited

FOREIGN PATENT DOCUMENTS

| | | | |
|---|---|---|---|
| CN | 110560101 | A | 12/2019 |
| CN | 114917946 | A | 8/2022 |
| CN | 117107291 | A | 11/2023 |
| WO | WO 2013098855 | A1 | 7/2013 |

OTHER PUBLICATIONS

Mohammed et al, "Phosphorous, boron and sulphur-doped silver tungstate-based nanomaterials toward electrochemical methanol oxidation and water splitting energy applications." International Journal of Hydrogen Energy 50 (2024): 1232-1245 (Year: 2024).*

(Continued)

*Primary Examiner* — Edna Wong
(74) *Attorney, Agent, or Firm* — Oblon, McClelland, Maier & Neustadt, L.L.P.

(57) ABSTRACT

A method for electrochemical oxidation of methanol includes applying a voltage to a solution, including methanol, in an electrochemical cell, including a working electrode that is at least partially coated with a catalyst composition, including phosphorus-doped $Ag_2WO_4$ nanoparticles. The amount of phosphorus present in the phosphorus-doped $Ag_2WO_4$ nanoparticles ranges from 5 to 30% of the total weight of the phosphorus-doped $Ag_2WO_4$ nanoparticles. When applying a voltage, the current density is greater than 5 milliamperes per square centimeter ($mA \cdot cm^{-2}$) at 0.58 Volt (V). During the application of voltage, the methanol is oxidized to form carbon dioxide and hydrogen.

20 Claims, 15 Drawing Sheets

(56) References Cited

OTHER PUBLICATIONS

Y. Wang, et al., "Z-type electronic structure and enhanced photocatalytic performance of silver tungstate—phosphorus and aluminum co-doped zinc oxide heterogeneous catalysts", Materials Technology—Advanced Performance Materials, vol. 32, Issue 9, Mar. 28, 2017 (2 pages).

Manman Jing et al., "The enhancement of photocatalytic hydrogen production over Ag2WO4 modified g-C3N4 with Pt as cocatalyst", Energy Sources, Part. A: Recovery, Utilization, and Environmental Effects, vol. 46, Issus 1, May 2, 2024 (2 pages).

* cited by examiner

METHOD FOR ELECTROCHEMICAL OXIDATION OF METHANOL

STATEMENT REGARDING PRIOR DISCLOSURE BY THE INVENTORS

Aspects of the present disclosure are described in Mohamed, M., et. al, "Phosphorous, boron and sulphur-doped silver tungstate-based nanomaterials toward electrochemical methanol oxidation and water splitting energy applications" International Journal of Hydrogen Energy, Volume 50, 2023, which is incorporated herein by reference in its entirety.

BACKGROUND

Technical Field

The present disclosure is directed to an electrochemical process, and particularly to an electrochemical method for oxidation of methanol using phosphorus-doped $Ag_2WO_4$ nanoparticles as a catalyst.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present disclosure.

Fuel cells, particularly direct methanol fuel cells (DMFCs), have emerged as a cleaner alternative to fossil fuels, gaining traction due to their high power output, efficient fuel use, and environmentally friendly energy conversion processes. In DMFCs, two main reactions occur: methanol oxidation reaction (MOR) at the anode and oxygen reduction reaction (ORR) at the cathode. The slow kinetics of ORR negatively impact the overall fuel cell efficiency.

Recent studies have shown that silver-based catalysts can outperform platinum in alkaline environments for the ORR, demonstrating comparable reaction kinetics and mechanisms while also being more stable and cost-effective. Due to the sluggish kinetics of ORR, overall fuel cell performance suffers, prompting ongoing efforts to identify effective ORR catalysts with low overpotential and good tolerance to methanol. Among various materials, the group of metallic tungstates, particularly $\alpha$-$Ag_2WO_4$, has garnered interest for its diverse applications, including adsorption, photoluminescence, and electrochemical sensing. However, limitations in visible light absorption and charge carrier separation have hampered the effectiveness of photocatalytic applications, particularly those reliant on UV illumination.

Accordingly, one object of the present disclosure is to develop a method for electrochemical oxidation of methanol. The electrochemical oxidation of methanol allows direct conversion of methanol into electrical energy with high efficiency, making it a promising approach for fuel cells in the context of clean energy production and efficient chemical conversion.

SUMMARY

In an exemplary embodiment, a method for electrochemical oxidation of methanol is described. The method includes applying a voltage to a solution including methanol in an electrochemical cell including a working electrode at least partially coated with a catalyst composition including phosphorus-doped $Ag_2WO_4$ nanoparticles. The amount of phosphorus present in the phosphorus-doped $Ag_2WO_4$ nanoparticles is in a range from 5 to 30% of the total weight of the phosphorus-doped $Ag_2WO_4$ nanoparticles. The current density during the applying of voltage is greater than 5 milliamperes per square centimeter ($mA \cdot cm^{-2}$) at 0.58 Volt (V). During the applying of voltage the methanol is oxidized to form carbon dioxide and hydrogen.

In some embodiments, the phosphorus-doped $Ag_2WO_4$ nanoparticles have $\alpha$-$Ag_2WO_4$ and $\beta$-$Ag_2WO_4$ crystallites and the ratio of $\beta$-$Ag_2WO_4$:$\alpha$-$Ag_2WO_4$ crystallites is in a range from 2:1 to 6:1.

In some embodiments, the phosphorus-doped $Ag_2WO_4$ nanoparticles have a ratio of $\beta$-$Ag_2WO_4$:$\alpha$-$Ag_2WO_4$ crystallites in a range from 3:1 to 5:1.

In some embodiments, the phosphorus-doped $Ag_2WO_4$ nanoparticles have a ratio of $\beta$-$Ag_2WO_4$:$\alpha$-$Ag_2WO_4$ crystallites in a range from 3.5:1 to 4.5:1.

In some embodiments, the amount of phosphorus present in the phosphorus-doped $Ag_2WO_4$ nanoparticles is in a range from 10 to 25% of the total weight of the phosphorus-doped $Ag_2WO_4$ nanoparticles.

In some embodiments, the amount of phosphorus present in the phosphorus-doped $Ag_2WO_4$ nanoparticles is in a range from 12 to 20% of the total weight of the phosphorus-doped $Ag_2WO_4$ nanoparticles.

In some embodiments, the current density during the applying is greater than 7 $mA \cdot cm^{-2}$ at 0.58 V.

In some embodiments, the current density during the applying is greater than 9 $mA \cdot cm^{-2}$ at 0.58 V.

In some embodiments, the mass activity during the applying is greater than 500 milliamperes per gram ($mA \cdot g^{-1}$).

In some embodiments, the mass activity during the applying is greater than 750 $mA \cdot g^{-1}$.

In some embodiments, the mass activity during the applying is greater than 1000 $mA \cdot g^{-1}$.

In some embodiments, the electro-chemical active surface area during the applying is greater than 6 millifarads per square centimeter ($mF \cdot cm^{-2}$).

In some embodiments, the electro-chemical active surface area during the applying is greater than 9 $mF \cdot cm^{-2}$.

In some embodiments, the electro-chemical active surface area during the applying is greater than 12 $mF \cdot cm^{-2}$.

In some embodiments, the phosphorus-doped $Ag_2WO_4$ nanoparticles have an electrical conductivity greater than $1.0 \times 10^{-6}$ inverse ohms per centimeter ($\Omega^{-} \cdot cm^{-1}$) at 140 kilohertz (kHz). In some embodiments, the phosphorus-doped $Ag_2WO_4$ nanoparticles have an electrical conductivity greater than $1.5 \times 10^{-6}$ $\Omega^{-} \cdot cm^{-1}$ at 140 kHz.

In some embodiments, the phosphorus-doped $Ag_2WO_4$ nanoparticles have an electrical conductivity greater than $2.0 \times 10^{-6}$ $\Omega^{-} \cdot cm^{-1}$ at 140 kHz.

In some embodiments, the solution includes methanol including a 1.0 M solution of methanol acidified with $H_2SO_4$ at a 0.5 M concentration.

In some embodiments, the surface area of the working electrode is in a range from 0.4 to 0.8 $cm^2$.

In some embodiments, the working electrode is additionally at least partially coated with a coating including polyvinylidene fluoride (PVDF) and carbon black.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
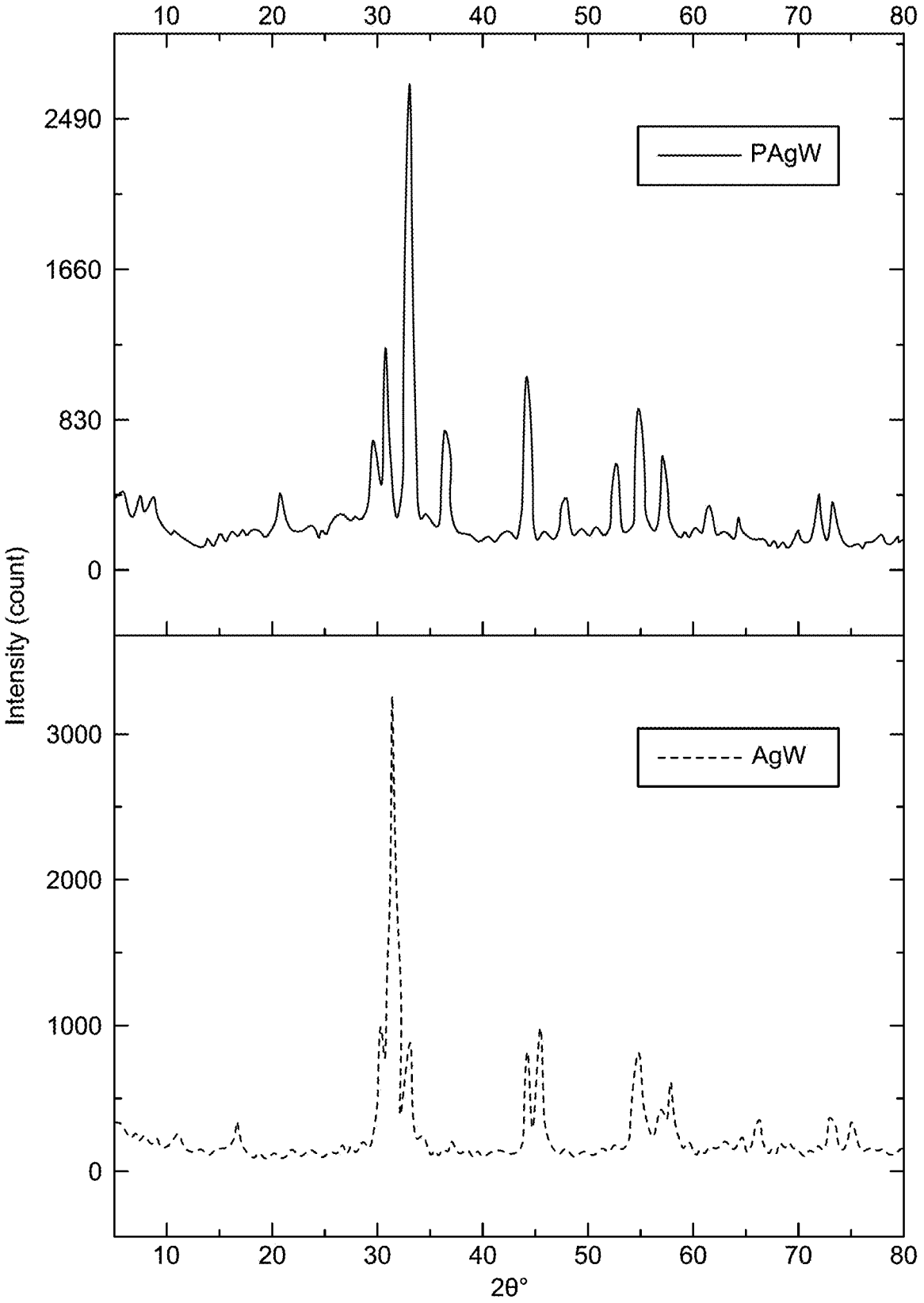
FIG. 1 shows X-ray diffraction (XRD) patterns of $Ag_2WO_4$ (AgW) and phosphorus-doped $Ag_2WO_4$ (P@AgW) samples, according to certain embodiments.

In the drawings, like reference numerals designate identical or corresponding parts throughout the several views. Further, as used herein, the words "a", "an" and the like generally carry a meaning of "one or more", unless stated otherwise.

Furthermore, the terms "approximately," "approximate", "about" and similar terms generally refer to ranges that include the identified value within a margin of 20%, 10%, or preferably 5%, and any values therebetween.

As used herein, the term 'current density' refers to the amount of electric current flowing per unit area of a conductor or surface. It is typically expressed in units of amperes per square meter ($A/m^2$).

As used herein, the term 'mass activity' refers to the measure of the catalytic activity of a catalyst per unit mass. It is typically expressed in units such as milliamperes per gram (mA/g) and provides insight into how effectively a catalyst can facilitate a reaction relative to its weight. Higher mass activity indicates a more efficient catalyst, allowing for greater reaction rates at lower amounts of catalyst material.

As used herein, the term 'electro-chemical active surface area' refers to the surface area of an electrode that is available for electrochemical reactions. It is a useful parameter in evaluating the performance of catalysts and electrodes in electrochemical systems, such as batteries and fuel cells. ECSA is typically measured using techniques like cyclic voltammetry and is expressed in units such as square centimeters ($cm^2$) or square meters ($m^2$). A larger ECSA generally correlates with improved reaction rates and overall efficiency in electrochemical processes.

As used herein, the term 'electrical conductivity' refers to the ability of a material to conduct electric current. It is defined as the ratio of the current density to the electric field strength and is typically measured in siemens per meter (S/m). High electrical conductivity indicates that a material can easily allow the flow of electric current, while low conductivity suggests that it acts as an insulator. High electrical conductivity is desired in various applications, including electronics, materials science, and energy storage.

As used herein, the term 'electrochemical cell' refers to a device that facilitates the conversion of chemical energy into electrical energy, or vice versa, through electrochemical reactions. It typically comprises two electrodes: an anode, where oxidation occurs (the loss of electrons), and a cathode, where reduction takes place (the gain of electrons). These electrodes are immersed in an electrolyte, which is a conductive medium that allows for the movement of ions between them.

Aspects of the present disclosure are directed toward a method for the electrochemical oxidation of methanol using a one-step precipitation technique to synthesize phosphorus-doped $Ag_2WO_4$ (AgW) with a cetyltrimethylammonium bromide template. The resulting spherical P@AgW nanocomposite shows excellent electrocatalytic activity for methanol oxidation in acidic conditions, offering impressive performance and durability. Benefits include an unique $\beta$-$Ag_2WO_4$/$\alpha$-$Ag_2WO_4$ ratio, Ag—O—P bond formation, increased electrochemical surface area, and improved charge transfer efficiency. This method supports the scalable production of effective catalysts for electrochemical applications.

A method for electrochemical oxidation of methanol is described. The method includes applying a voltage to a solution including methanol in an electrochemical cell including a working electrode at least partially coated with a catalyst composition including phosphorus-doped $Ag_2WO_4$ nanoparticles. In some embodiment, the voltage applied may be 0.2 V to 2 V, 0.4 V to 1.5 V, 0.5 V to 1.0 V, 1.5 V to 2.0 V, and 1.75 V to 2.0V. The application of voltage in an electrochemical cell initiates a series of complex electrochemical reactions in a methanol solution, enhancing the oxidation process at the surface of the working electrode. When a voltage is applied, it generates an electric field that influences the movement of charged species, causing methanol molecules and protons in the electrolyte to migrate toward the electrode surface. Upon reaching the electrode, methanol molecules participate in oxidation reactions, during which they lose electrons. This electron transfer process is fundamental to the overall reaction and facilitates the formation of various intermediates, including formaldehyde and formic acid. As the oxidation progresses, these intermediates further react, leading to the complete oxidation of methanol into carbon dioxide ($CO_2$) and protons ($H^+$). The generation of carbon dioxide marks the endpoint of the methanol oxidation pathway, while the protons can contribute to the overall electrochemical reaction by participating in other processes within the cell. The efficiency of this oxidation process is heavily reliant on the surface characteristics of the working electrode, including its electrochemical active surface area and catalytic properties. Enhanced surface areas allow for increased adsorption of methanol, leading to higher rates of reaction. During the applying of voltage the methanol is oxidized to form carbon dioxide and hydrogen.

The solution including methanol includes a 1.0 M solution of methanol acidified with $H_2SO_4$ at a 0.5 M concentration. In some embodiments, the solution of methanol may have concentration of 0.5 M, 0.75 M, 1.5 M, 2.0 M. In some embodiments, the acid used may be HCl, $HNO_3$, $H_2PO_4$, $CH_3COOH$, $HClO_4$. In some embodiments, the concentration of acid may be 0.5 M, 0.75 M, 1.5 M, 2.0 M. The choice of a 1.0 M methanol solution acidified with 0.5 M sulfuric acid ($H_2SO_4$) is selected for enhancing the electrochemical oxidation process. The acidic environment provided by the sulfuric acid enhances the electrochemical reactivity of methanol by promoting the formation of protons ($H^+$) in the solution. These protons facilitate the oxidation reaction at the anode, as they can participate in the electron transfer processes that are integral to methanol oxidation. Additionally, the presence of sulfuric acid helps to stabilize the electrochemical environment by maintaining a consistent pH, which is beneficial for the performance of the catalyst involved in the oxidation reaction. An acidic medium can improve the adsorption of methanol molecules onto the catalyst surface, thereby increasing the availability of active sites for the oxidation reaction. This leads to higher current densities and improved overall reaction kinetics. The combination of methanol and sulfuric acid creates a conducive medium for effective ion transport, which sustains the flow of electric current during the electrochemical process. The use of a concentrated methanol solution also ensures that there is an abundant supply of reactant, further enhancing the efficiency of the oxidation reaction. Overall, this specific formulation promotes suitable conditions for methanol oxidation, maximizing the performance of the electrochemical cell.

The surface area of the working electrode plays a role in the electrochemical oxidation of methanol, as it directly influences the rate and efficiency of the oxidation reactions occurring at the electrode interface. A larger surface area provides more active sites for the adsorption of methanol molecules, facilitating their interaction with the electrode material. This increased availability of active sites enhances the kinetics of the electrochemical reaction, allowing for a higher current density and improved overall reaction rates. In the context of methanol oxidation, an electrode with an expanded surface area can effectively accommodate more methanol and protons, thereby promoting the oxidation process to carbon dioxide and protons. This is because the electrochemical oxidation of methanol involves complex mechanisms that require optimal contact between the reactants and the electrode. Nanostructured or porous electrode materials are often employed to maximize surface area, which not only enhances the reaction rate but also improves the mass transport of reactants to the electrode surface. Greater surface area can help mitigate issues such as catalyst deactivation or poisoning, which can occur due to the accumulation of reaction byproducts. By ensuring that there are sufficient active sites available, the electrode can maintain its performance over extended periods. Therefore, enhancing the surface area of the working electrode maximizes the electrocatalytic performance in methanol fuel cells and other electrochemical systems. In some embodiments, the surface area of the working electrode is in a range from 0.4 to 0.8 $cm^2$, 0.5 to 0.7 $cm^2$ and 0.6 to 0.8 $cm^2$. In preferred embodiments, the electrochemical active surface area during voltage application is 0.6 $cm^2$.

The working electrode is enhanced by a coating that includes polyvinylidene fluoride (PVDF) and carbon black, which serves several functions in the electrochemical oxidation of methanol. PVDF is a highly stable and chemically resistant polymer that provides an excellent binder for the electrode material. Its hydrophobic nature helps to create a stable matrix that retains the carbon black particles, which are known for their desirable electrical conductivity and high surface area. Carbon black facilitates electron transport across the electrode surface, improving the electrical conductivity of the electrode. This enhanced conductivity allows for more efficient electron transfer during the electrochemical reactions, leading to improved current densities. Moreover, the high surface area of carbon black increases the electrochemical active surface area, providing more active sites for methanol adsorption and subsequent oxidation. The combination of PVDF and carbon black also contributes to the mechanical stability of the electrode. This prevents the delamination of the coating and ensures consistent performance over time. Additionally, the hydrophobic properties of PVDF can help manage the liquid environment at the electrode interface, promoting effective contact between the electrolyte and the electrode surface. Overall, the use of a PVDF and carbon black coating on the working electrode not only enhances conductivity and electrochemical activity but also improves the durability and stability of the electrode, making it more effective for the oxidation of methanol in electrochemical systems.

The efficiency of this oxidation process is enhanced by the presence of the phosphorus-doped $Ag_2WO_4$ nanoparticles coated on the working electrode. These nanoparticles not only provide active sites for the oxidation reaction but also facilitate faster electron transfer and reduce energy barriers, thereby improving overall reaction kinetics. As a result, the applied voltage not only drives the reaction forward but also maximizes the conversion of methanol into valuable products, making this process particularly relevant for applications in fuel cells and other electrochemical systems where efficient energy conversion is desired.

The electrocatalytic oxidation of methanol using phosphorus-doped $Ag_2WO_4$ nanoparticles involves the synergistic roles of each constituent element, contributing to the overall efficiency of the process. Silver (Ag) plays a pivotal role as an active component in the catalyst, facilitating electron transfer during the oxidation reaction. Its high conductivity and ability to form stable metal bonds enhance the catalytic activity by providing numerous active sites for methanol adsorption and subsequent oxidation. Tungsten (W) contributes to the structural integrity and stability of the nanoparticles. The unique electronic properties of tungsten enable the formation of strong bonds with methanol and its oxidation intermediates, promoting a smoother reaction pathway. Furthermore, tungsten's presence helps stabilize the oxidation states of silver, preventing the catalyst from deactivating over time. Phosphorus (P) doping introduces additional electron-rich sites within the $Ag_2WO_4$ lattice. This modification enhances the electronic conductivity of the material and creates new active sites for methanol adsorption, thereby improving the overall reaction kinetics. The P dopant can also influence the charge distribution within the nanoparticles, leading to enhanced interactions with methanol molecules and promoting faster electron transfer rates. Together, these elements work together to enhance the electrocatalytic activity of the phosphorus-doped $Ag_2WO_4$ nanoparticles. The combination of efficient electron transfer, stable reaction intermediates, and increased active sites not only accelerates the oxidation of methanol but also enhances the durability and performance of the catalyst in practical applications, such as in fuel cells.

In some embodiments, the amount of phosphorus present in the phosphorus-doped $Ag_2WO_4$ nanoparticles is in a range from 5 to 30% of the total weight of the phosphorus-doped $Ag_2WO_4$ nanoparticles. Additionally, other embodiments specify that the phosphorus amount falls between 10% and 25%, while some indicate a range of 12% to 20%. In preferred embodiment, the amount of phosphorus present in the phosphorus-doped $Ag_2WO_4$ nanoparticles is 20% of the total weight of the phosphorus-doped $Ag_2WO_4$ nanoparticles.

The phosphorus-doped $Ag_2WO_4$ nanoparticles consist of two distinct crystallite phases: $\alpha$-$Ag_2WO_4$ and $\beta$-$Ag_2WO_4$, each contributing unique properties to the overall material. The $\alpha$-$Ag_2WO_4$ phase is characterized by its orthorhombic structure, which is known for its stability and excellent photocatalytic activity. This phase typically exhibits favorable electronic properties, enhancing the charge separation efficiency during electrochemical reactions, whereas, the $\beta$-$Ag_2WO_4$ phase, which can emerge as a result of doping or changes in synthesis conditions, possesses a different crystallographic arrangement that may provide enhanced reactivity and improved conductivity. The presence of both phases within the nanoparticles creates a synergistic effect that enhance their performance in applications such as electrocatalysis. The $\alpha$-phase supports stable reaction kinetics, while the $\beta$-phase can facilitate higher surface activity and electron mobility, thus contributing to an overall increase in the efficiency of processes like methanol oxidation.

In some embodiments, the phosphorus-doped $Ag_2WO_4$ nanoparticles have $\alpha$-$Ag_2WO_4$ and $\beta$-$Ag_2WO_4$ crystallites, and the ratio of $\beta$-$Ag_2WO_4$:$\alpha$-$Ag_2WO_4$ crystallites is in a range from 2:1 to 6:1. In some embodiments, the phosphorus-doped $Ag_2WO_4$ nanoparticles have $\alpha$-$Ag_2WO_4$ and $\beta$-$Ag_2WO_4$ crystallites and the ratio of $\beta$-$Ag_2WO_4$:$\alpha$-$Ag_2WO_4$ crystallites is in a range from 3:1 to 5:1. In some embodiments, the phosphorus-doped $Ag_2WO_4$ nanoparticles have $\alpha$-$Ag_2WO_4$ and $\beta$-$Ag_2WO_4$ crystallites and the ratio of $\beta$-$Ag_2WO_4$:$\alpha$-$Ag_2WO_4$ crystallites is in a range from 3.5:1 to 4.5:1. In preferred embodiment, the phosphorus-doped $Ag_2WO_4$ nanoparticles have $\alpha$-$Ag_2WO_4$ and $\beta$-$Ag_2WO_4$ crystallites and the ratio of $\beta$-$Ag_2WO_4$:$\alpha$-$Ag_2WO_4$ crystallites 4:1.

In some embodiments, the phosphorus-doped $Ag_2WO_4$ nanoparticles are spherical, with an average diameter in a range from a lower limit of any of 5, 10, 15, and 20 nm to an upper limit of any of 25, 30, 35, and 40 nm. In a preferred embodiment, the average diameter of the phosphorus-doped $Ag_2WO_4$ nanoparticles is in a range from 15 to 25 nm. In some embodiments, the phosphorus-doped $Ag_2WO_4$ nanoparticles have an irregular spherical shape. One with ordinary skill in the art will understand that other shapes may also be used.

Current density plays a role in the electrochemical oxidation of methanol when a voltage is applied. It indicates the rate of charge transfer per unit area at the electrode surface, reflecting the efficiency of the electrochemical reaction. Higher current density suggests that more methanol molecules are oxidized at the electrode, leading to increased reaction rates and improved power output in fuel cell applications. It also helps in assessing the performance of the electrocatalyst; a catalyst that enables higher current densities at lower voltages is considered more effective. Additionally, maintaining a favorable current density is beneficial for ensuring the stability and longevity of the catalyst, as excessive current densities can lead to increased degradation or poisoning of the active sites. Therefore, monitoring current density during the electrochemical process enhances the overall efficiency and effectiveness of methanol oxidation reactions.

In some embodiments, the current density exceeds 5 milliamperes per square centimeter ($mA \cdot cm^{-2}$) when a voltage of 0.58 Volt (V) is applied. Additionally, other embodiments indicate that the current density is greater than 7 $mA \cdot cm^{-2}$ at 0.58 V, and in some embodiments, it is greater than 9 $mA \cdot cm^{-2}$ at the same voltage. In a preferred embodiment, the current density during the application of voltage is 10 $mA \cdot cm^{-2}$ at 0.58 V. It will be understood by one with ordinary skill in the art that other current densities are possible, but may negatively impact performance or stability.

Mass activity plays a role in the electrochemical oxidation of methanol by indicating the effectiveness of the electrocatalyst in facilitating the reaction per unit mass. It is defined as the current density produced by the catalyst normalized to its mass, typically expressed in mA/g. During the application of voltage, higher mass activity signifies that the catalyst can generate a greater current for a given amount of active material, leading to more efficient methanol oxidation. This efficiency enables practical applications such as fuel cells, where maximizing current output for a minimal amount of catalyst can enhance overall performance and reduce costs. Moreover, a catalyst with high mass activity can facilitate quicker reactions, lower overpotentials, and improved stability, contributing to faster energy conversion rates and better operational efficiency.

In some embodiments, the mass activity during the application of voltage is greater than 500 milliamperes per gram ($mA \cdot g^{-1}$). In some embodiments, the mass activity during the applying of voltage is greater than 750 $mA \cdot g^{-1}$. In some embodiments, the mass activity during the applying of voltage is greater than 1000 $mA \cdot g^{-1}$. In preferred embodiment, the mass activity during the applying of voltage is 1172 mA $g^{-1}$.

The electrochemical active surface area (ECSA) is paramount in the electrocatalytic oxidation of methanol, as it directly affects the efficiency and the reaction rate at the electrode interface. ECSA represents the portion of the electrode surface that actively engages in electrochemical reactions, and it often exceeds the geometric surface area due to the intricate structures of nanomaterials, which may include pores and roughened surfaces. When the ECSA is higher, it provides a greater number of active sites for methanol molecules to adsorb, promoting their conversion into products such as carbon dioxide and protons. This increased adsorption leads to more effective electron transfer, thereby raising the overall current density and enhancing the kinetics of the oxidation reaction. A higher ECSA contributes to improved mass activity, allowing the system to achieve more efficient electrochemical processes. In some embodiments, the electrochemical active surface area during voltage application exceeds 6 millifarads per square centimeter ($mF \cdot cm^{-2}$). Additionally, in some embodiments, this surface area may be greater than 9 $mF \cdot cm^{-2}$, and in further embodiments, it may exceed 12 $mF \cdot cm^{-2}$.

Electrical conductivity plays a role in the electrochemical oxidation of methanol, directly affecting the efficiency and kinetics of the reaction at the electrode interface. High electrical conductivity in electrode materials allows for efficient movement of charge carriers, such as electrons, which facilitate the oxidation process. When a voltage is applied, electrons must be transferred from the electrode to the methanol molecules; thus, a conductive electrode minimizes resistance and ensures that sufficient current flows to drive the reaction effectively. In methanol oxidation the simultaneous transfer of electrons and movement of ions within the electrolyte must also be facilitated. High electrical conductivity in the electrode enhances the coupling between electron and ion transport, leading to more effective mass transfer of reactants to the active sites on the electrode surface. This synergy maintains high current densities, which in turn improves the overall reaction rates and catalytic performance. Furthermore, materials with high electrical conductivity often exhibit better stability and durability under operating conditions, which is beneficial for long-term applications in fuel cells and other electrochemical devices. Thus, electrical conductivity is a fundamental parameter that directly influences the efficiency, reaction kinetics, and overall performance of electrochemical systems involving methanol oxidation.

In some embodiments, the phosphorus-doped $Ag_2WO_4$ nanoparticles have an electrical conductivity at 140 kilohertz (kHz), greater than $1.5\times10^{-6}$ $\Omega^{-}\cdot cm^{-1}$ at 140 kHz, greater than $2.0\times10^{-6}$ $\Omega^{-1}\cdot cm^{-1}$ at 140 kHz. In preferred embodiments, the phosphorus-doped $Ag_2WO_4$ nanoparticles have an electrical conductivity $2.5\times10^{-6}$ $ohm^{-1}$ $cm^{-1}$ at 140 kHz.

EXAMPLES

The following examples demonstrate a method for electrochemical oxidation of methanol as described herein. The examples are provided solely for illustration and are not to be construed as limitations of the present disclosure, as many variations thereof are possible without departing from the spirit and scope of the present disclosure.

Example 1: Preparation of P@α-$Ag_2WO_4$ Nanohybrids

The α-$Ag_2WO_4$ nanoparticles were manufactured by a simple precipitation route at 80° C. in the presence of the cationic surfactant cetyltrimethylammonium bromide (CTAB) ($C_{19}H_{42}NBr$) as follows. Solution A was formed by dissolving $6.5\times10^{-3}$ mol of silver nitrate ($AgNO_3$) in 30 ml of bidistilled water; solution B was formed by dissolving $3.6\times10^{-3}$ mol of dihydrate sodium tungstate ($Na_2WO_4 \cdot 2H_2O$) and 0.7 g of CTAB in 40 mL of bidistilled water. The solution B was heated under continuous stirring at 80° C. After that, solution A of silver nitrate was added to solution B of sodium tungstate and permitted to stir for 15 min at 80° C. The precipitate was subsequently separated and rinsed multiple times with distilled water and ethanol to eliminate the $Na^+$ and $NO_3^-$ ions and any remaining organic molecules. After 12 hours, the product was dried at 60° C. The sample was denoted as AgW.

Example 2: Synthesis of P-Doped $Ag_2WO_4$

P-doped α-$Ag_2WO_4$ nanoparticles were created using the same procedure described for synthesizing the α-$Ag_2WO_4$, with the addition of sodium phosphate to a 30 ml solution of sodium tungstate under continuous stirring at 80° C. in the presence of CTAB (0.7 g). Sliver nitrate solution was inserted to the above solution at 80° C. and agitated for 15 min to synthesize the 20% P@AgW photocatalyst. Finally, after filtering and washing numerous times with distilled water and ethanol, the residue was dried for 12 hours at 60° C.

Example 3: Characterization

X-ray diffraction (XRD) was used to identify the crystalline states in each specimen studied, employing the JDX-8030 X-ray, JEOL, made in Japan. Cu-filtered CuKα radiation (1.5418 Å) powered at 45 kV and 10 mA was used to run the patterns. The specimens were tested at ambient temperatures in a range of 2θ=5 to 80°. The Fourier-transform infrared spectroscopy (FTIR) spectra of the specimens were evaluated using a KBr pellet on a Bruker-TENSOR Series-FTIR-Germany. The surface morphologies of the obtained samples were analyzed by High-Resolution Transmission Electron Microscopy (HRTEM) images obtained using a Tecnai-G20 (USA) transmission electron microscope with a 200 kV speed voltage. The binding energy values of the fabricated catalysts were determined using a KRATOS-AXIS DLD analyzer and adjusted with C1s (284.6 eV) after monochromatic Al—Kα irradiation. Using a programmable LCR bridge (HIOKI: IM 3536), the electrical properties ($R_{DC}$ and dielectric constant (ε') were assessed at fixed voltages of 1 volt, 0 Hz, and 25° C. The formula $\varepsilon'=(C/\varepsilon^o)\times(t/A_s)$ was used to determine the values for ε', where C is the equivalent capacitance, t is the specimen width, $\varepsilon^o$ is the vacuum's permittivity, and $A_s$ is the sample's measuring area. With the help of the Oxford *INCA* X-Act from Oxford Instruments in the UK, the Energy-Dispersive X-ray Spectroscopy (EDX) analysis was performed utilizing the line scan analysis approach. X-ray diffraction was utilized to assess the crystal structure, size, and impact of the doping process on the crystal structure, The diffraction pattern of CTAB-assisting $Ag_2WO_4$ formation and The orthorhombic α-$Ag_2WO_4$ phase was discovered to exhibit the following crystallographic planes in CTAB assisting silver tungstate (AgW; Joint Committee on Powder Diffraction Standards (JCPDS) no. 034-0061): (110), (011), (002), (231), (400), (402), (361), (460), (333), (462), (633), and (404), indicating the formation of α-$Ag_2WO_4$. In addition, one more peak in the (042) plane is related to the phase of β-$Ag_2WO_4$ (JCPDS no. 33-1195). The doping of $Ag_2WO_4$ with phosphorous (P@AgW) (FIG. 1) shows a huge effect on the crystal structure of $Ag_2WO_4$. It demonstrates the formation of several peaks associated with the β-$Ag_2WO_4$ phase (JCPDS no. 33-1195). Also, the pattern showed that the intensity of the peaks at 28.9° and 30.7° associated with the (002) and (231) planes, related to the α-$Ag_2WO_4$ phase, is reduced, representing 20.8% compared to the intense β-$Ag_2WO_4$ phase.

Figure 2B:
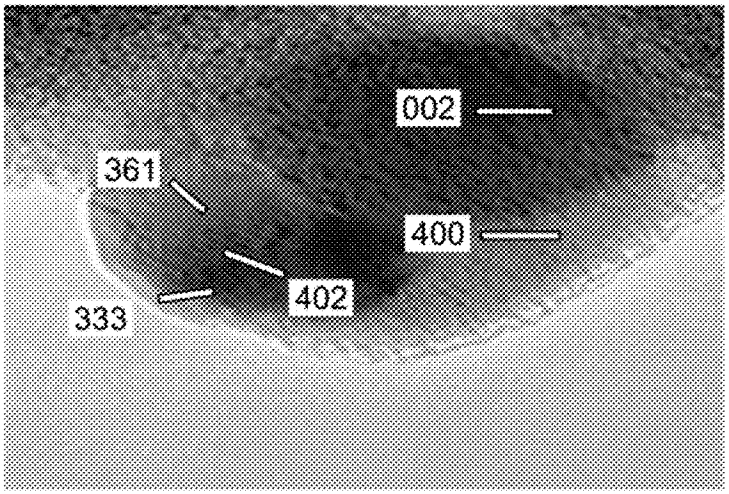
FIG. 2B shows a high-resolution transmission electron microscopy (HRTEM) image of the AgW sample according to certain embodiments.
Figure 2A:
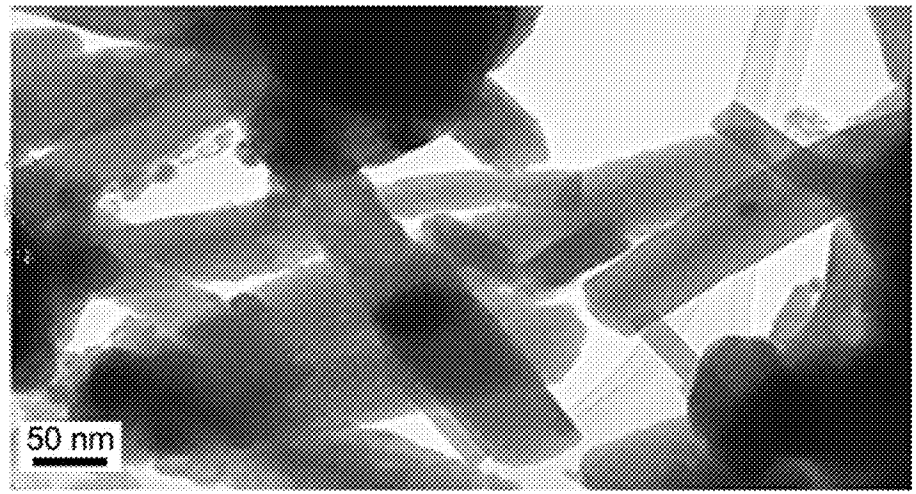
FIG. 2A shows a transmission electron microscopy (TEM) image of the AgW sample according to certain embodiments.
Figure 2D:
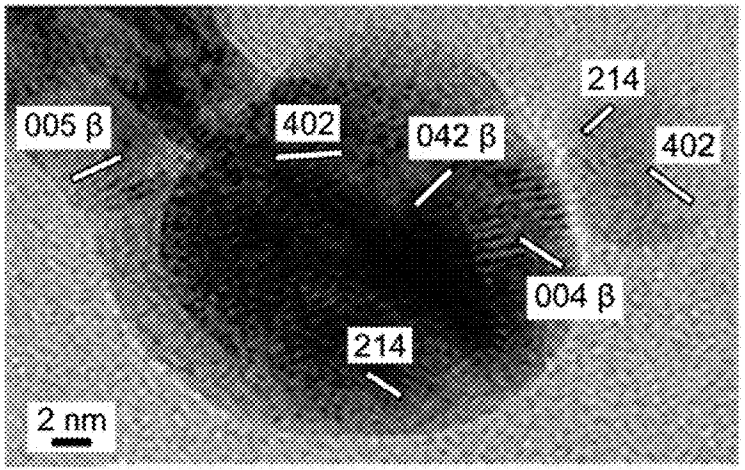
FIG. 2D shows a HRTEM image of the P@AgW sample, according to certain embodiments.
Figure 2C:
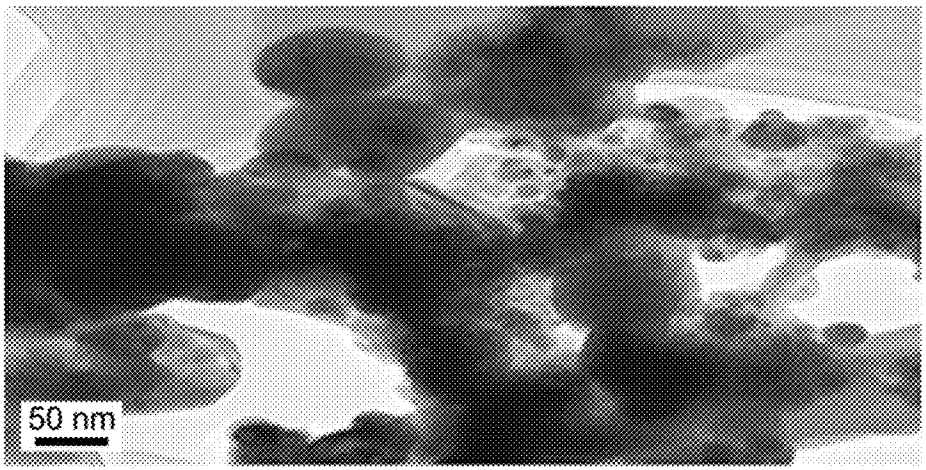
FIG. 2C shows a TEM image of the P@AgW sample, according to certain embodiments.

The morphological structure of AgW, revealed by TEM-HRTEM observations shows nanorods with widths of 57.4 nm and lengths of 302.4 nm, as well as a few spherical particles with a 31.8 nm diameter (FIG. 2A-FIG. 2B). These nanorods are good evidence of "oriented attachment" growth, in which the individual particles were aligned similar to bricks in a wall. Thus, it may be hypothesized that CTAB surfactant may function as a particle transporter and a modifier during the creation process of $Ag_2WO_4$, resulting in the orientation growth of $Ag_2WO_4$ nanorods. The CTAB surfactant accelerates the reaction of the growth units and leads to their oriented growth. CTAB is an ionic compound that ionizes completely in water ($CTAB \rightarrow CTA^+ + Br^-$). Since negative $WO_4^{-2}$ ions exist in the solution of $Na_2WO_4$, whereas $CTA^+$ is positively charged with a tetrahedral head and a long hydrophobic tail, the $CTA^+$-$WO_4^{-2}$ ion pairs are formed by electrostatic interaction. Adding $AgNO_3$ solution to the previously formed $CTA^+$-$WO_4^{-2}$ ion pairs form a combination of CTAB and $Ag_2WO_4$ according to the reaction. $CTA^+$-$[WO_4^{-2}]+2Ag^+ \rightarrow Ag_2WO_4+CTA^+$ led to the oriented $Ag_2WO_4$ growth, resulting in the nanorods. In agreement with the XRD results, the corresponding HRTEM results show the presence of different fringes with varying spacings that correspond to the (002), (400), (361), (333), and (402) planes of $\alpha$-$Ag_2WO_4$. Varied spherical nanostructures with an average diameter of 20.1 nm in size are seen in the P@AgW images (FIGS. 2C-2D), indicating the effect of the doping process with phosphorous on the morphological structures. The presence of fringes with varying spacings in the corresponding HRTEM image indicates the presence of $\alpha$-$Ag_2WO_4$ by exposing the lattice planes (214) and (402), and $\beta$-$Ag_2WO_4$ by exposing the lattice planes (005), (004) confirming the formation of $\beta$-$Ag_2WO_4$ and $\alpha$-$Ag_2WO_4$ phases, matching with the XRD data. Due to aggregations of the doped structures, P-doped $Ag_2WO_4$ exhibited pore apertures in the mesopore range.

Figure 3A:
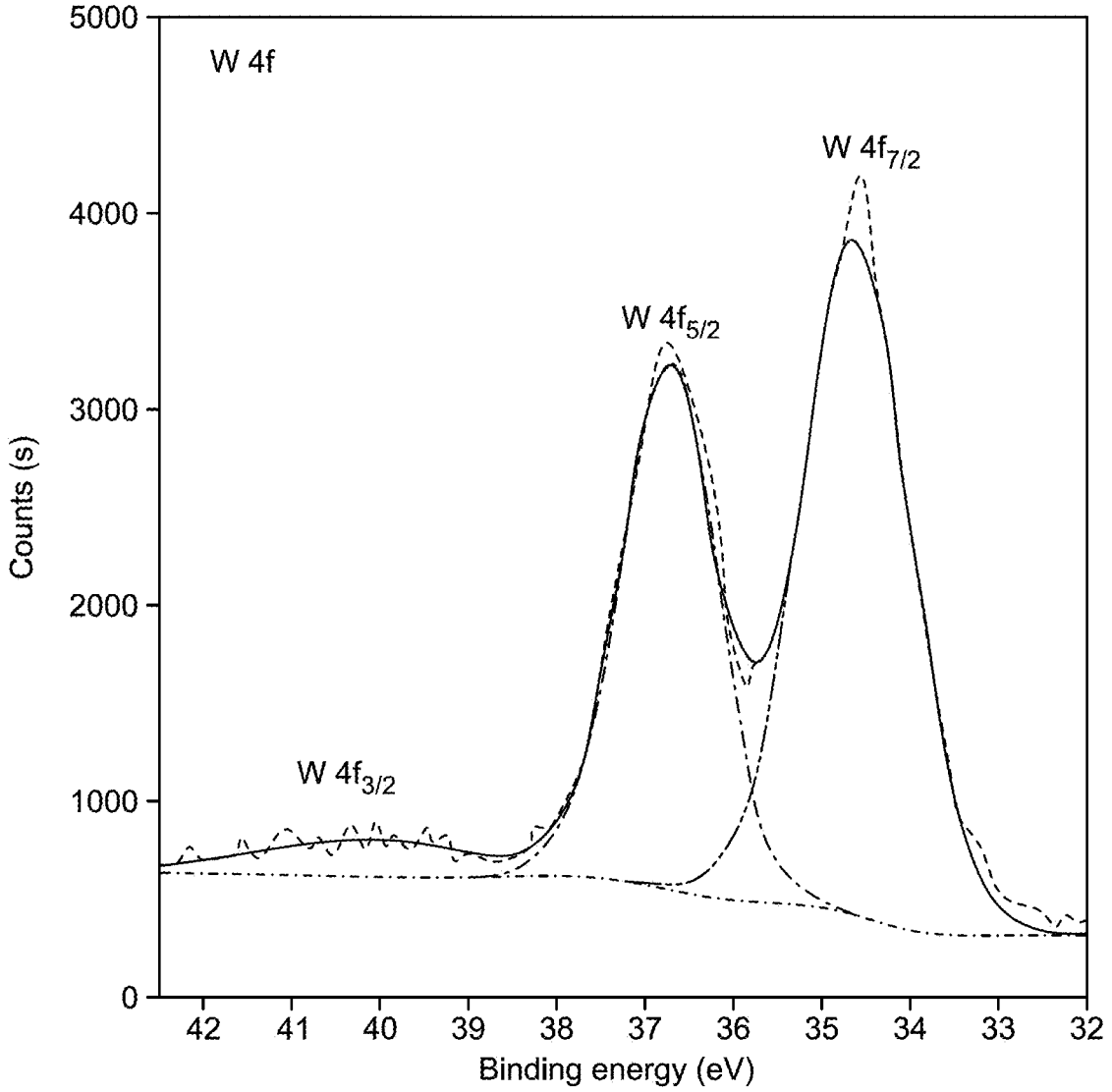
FIG. 3A shows a deconvoluted high-resolution x-ray photoelectron spectroscopy (XPS) spectra of W4f of AgW, according to certain embodiments.
Figure 3B:
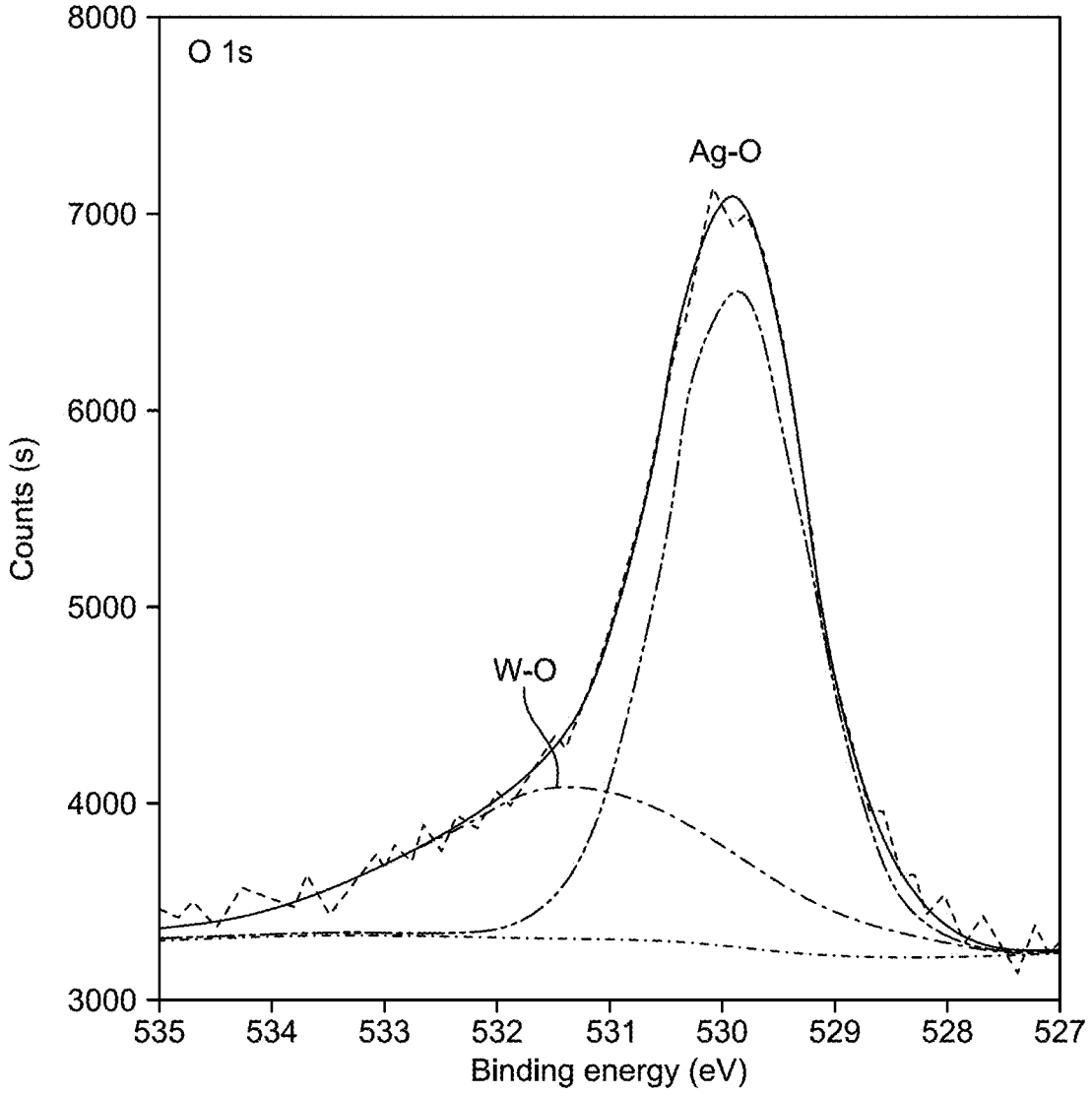
FIG. 3B shows a deconvoluted high-resolution XPS spectra of O1s of AgW, according to certain embodiments.
Figure 3C:
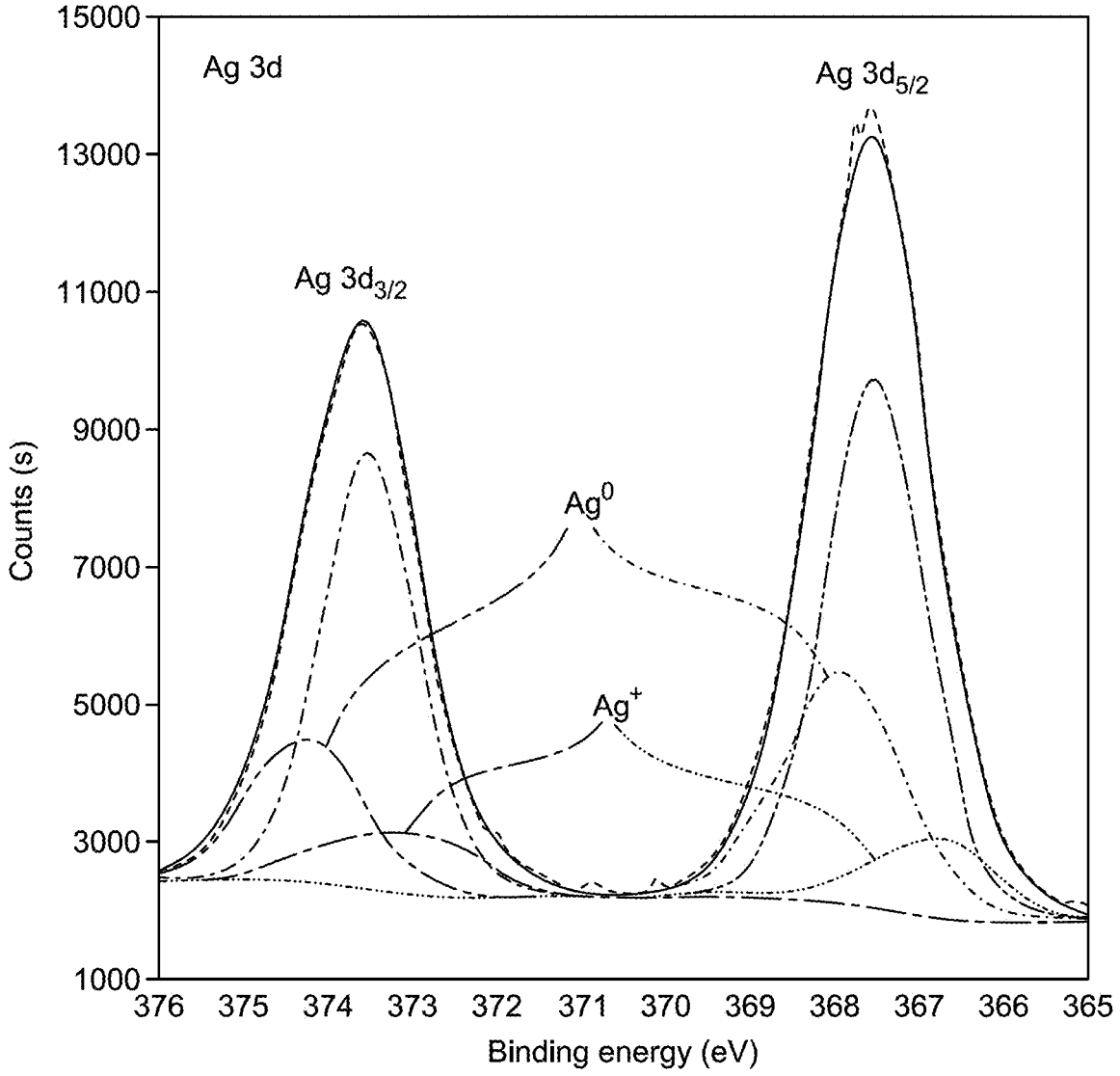
FIG. 3C shows a deconvoluted high-resolution XPS spectra of Ag3d of AgW, according to certain embodiments.
Figure 4A:
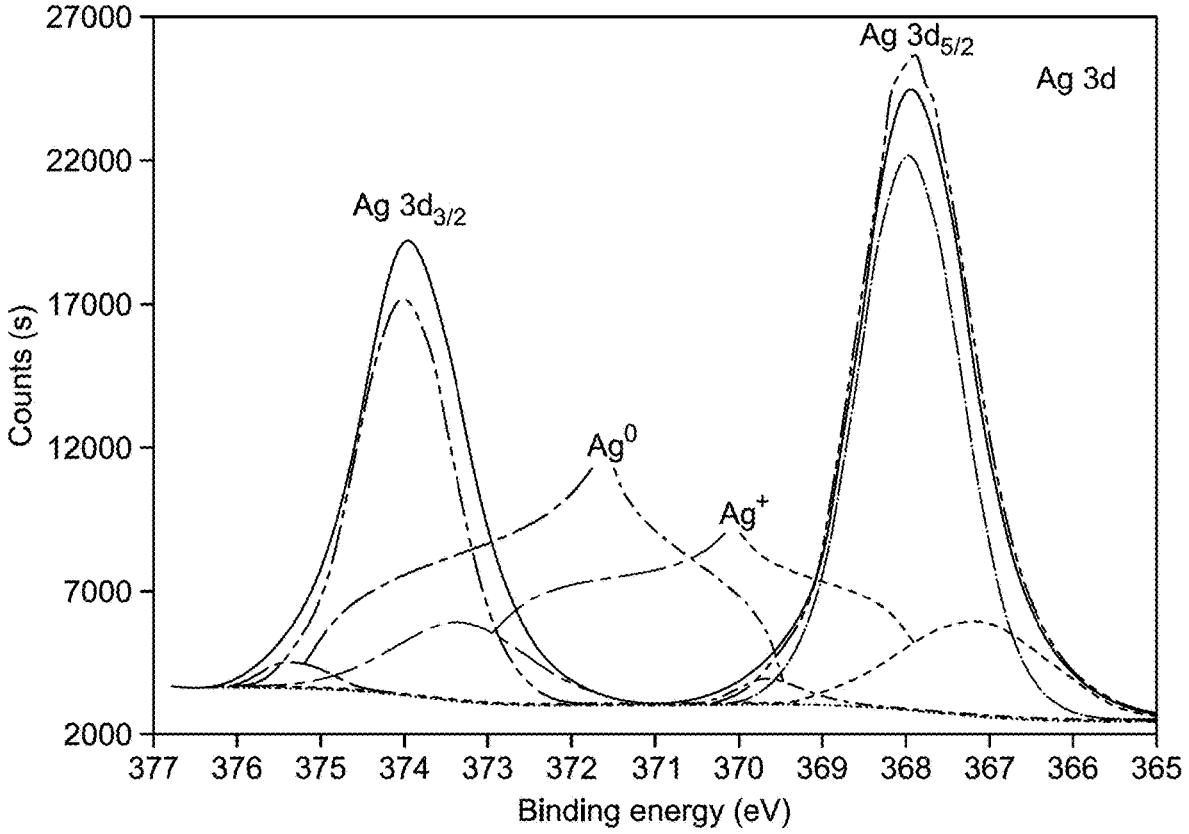
FIG. 4A shows a deconvoluted high-resolution XPS spectra of Ag3d of P@AgW, according to certain embodiments.
Figure 4B:
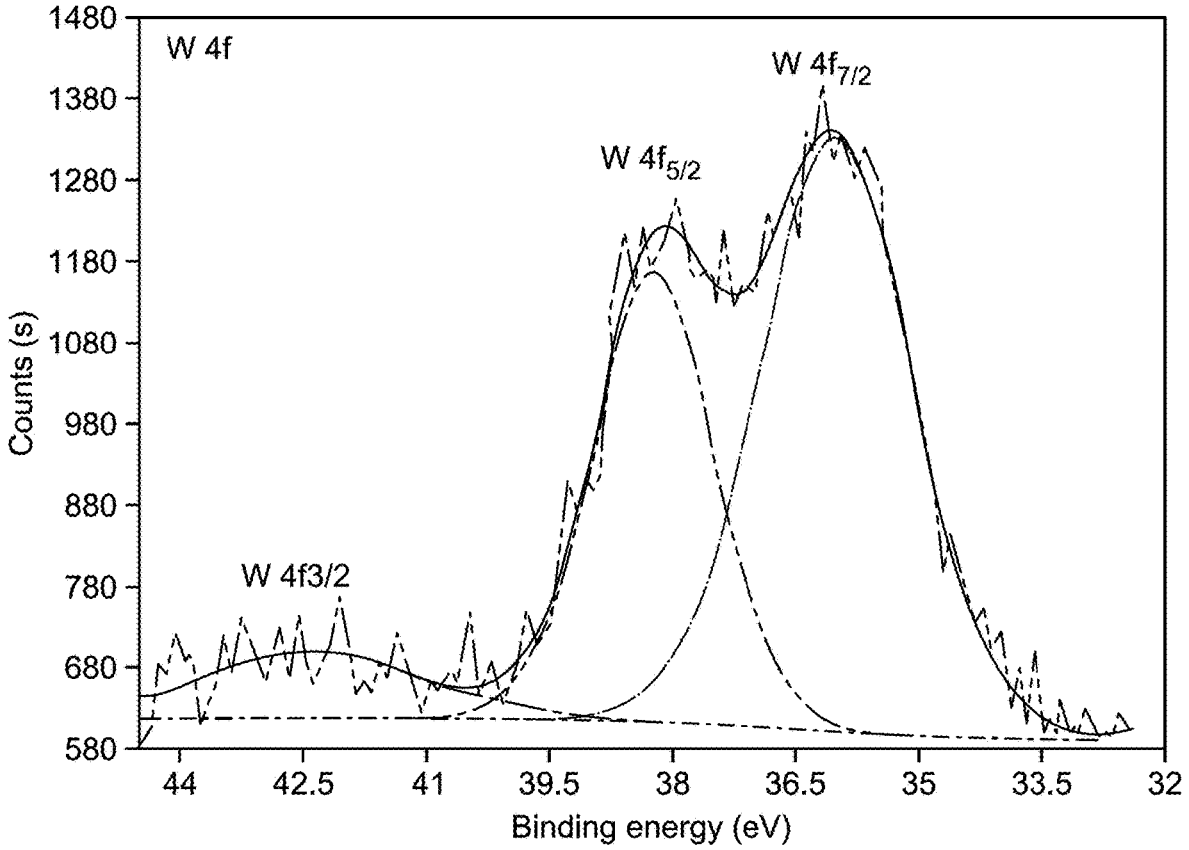
FIG. 4B shows deconvoluted high-resolution XPS spectra of W4f of P@AgW, according to certain embodiments.
Figure 4C:
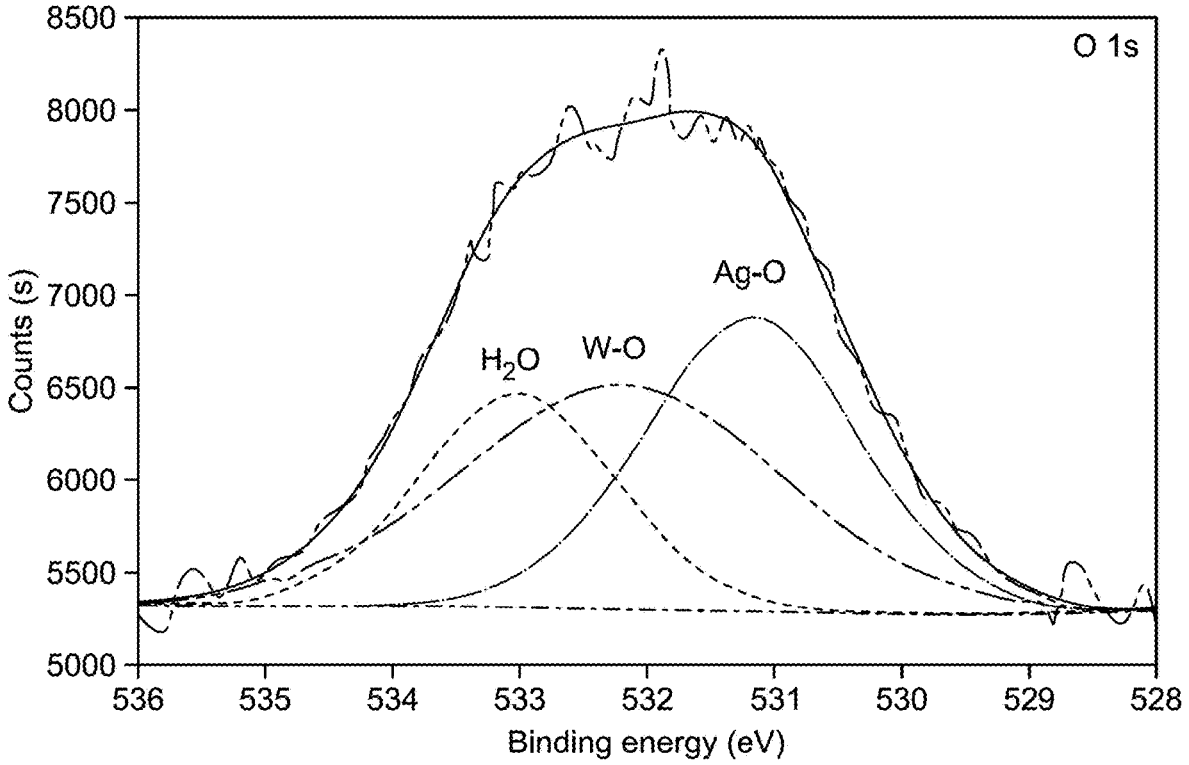
FIG. 4C shows a deconvoluted high-resolution XPS spectra of O1s of P@AgW, according to certain embodiments.
Figure 4D:
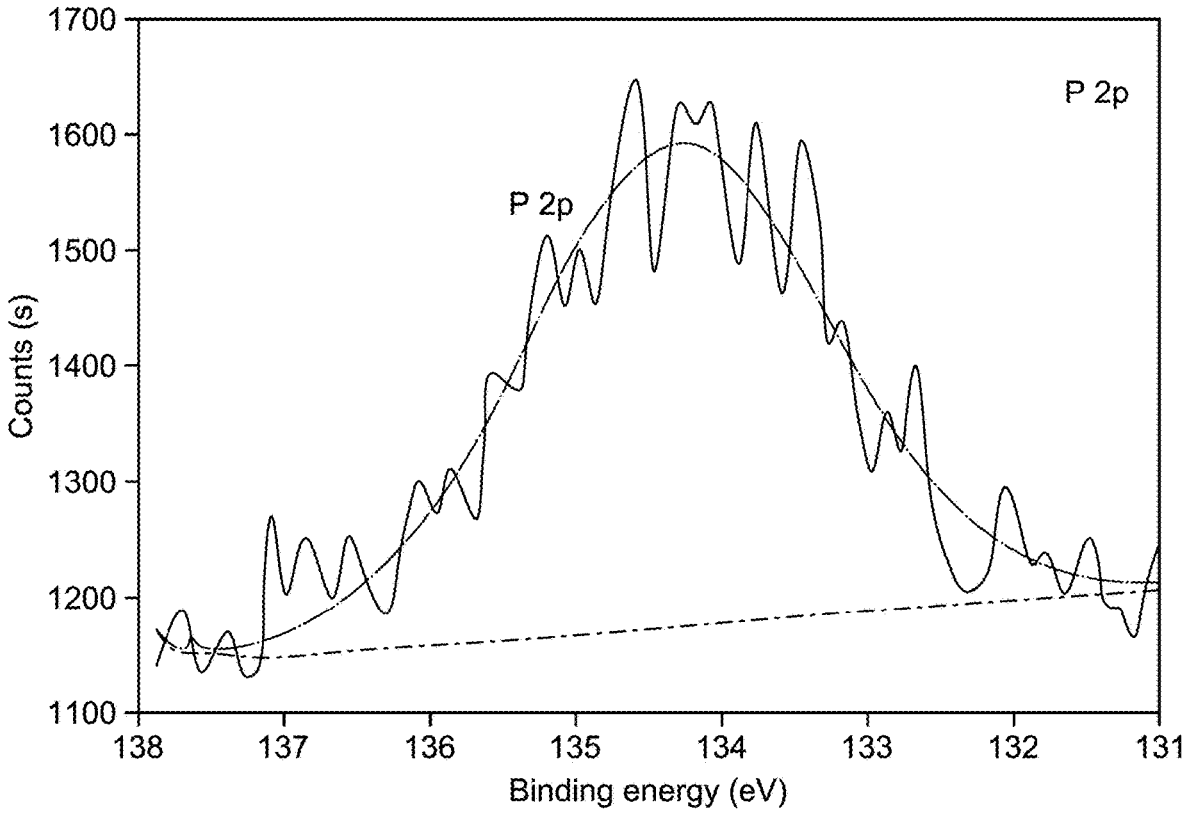
FIG. 4D shows a deconvoluted high-resolution XPS spectra of P 2p of P@AgW, according to certain embodiments.

X-ray Photoelectron Spectroscopy (XPS) analysis assessed the chemical components of AgW and P-doped AgW samples. The peaks of W, O, and Ag are seen in the XPS spectra of $\alpha$-$Ag_2WO_4$ (FIGS. 3A-3C). Peaks at 34.8, 36.8, and 40.2 eV associated with $W4f_{7/2}$, $W4f_{5/2}$, and $W4f_{3/2}$, correspondingly, are visible in the high-resolution W 4f XPS spectra of the as-synthesized sample elaborating that $W^{6+}$ species exist. Two peaks at 530.0 and 531.3 eV, which correspond to O1s generated via contacts with Ag—O and W—O, respectively, were seen in the deconvoluted XPS data for the O1s area (FIG. 3B). The occurrence of $Ag^+$ is indicated by the existence of two separate peaks in the Ag 3d spectra at 367.7 and 373.5 eV generated by Ag $3d_{5/2}$ and Ag $3d_{3/2}$. Results from deconvolution of the later peaks show that Ag nanoparticles are present, with a proportion of 31.1% relative to $Ag^+$, via peaks at 368.0 and 374.3 eV.

XPS of the P@AgW sample was exhibited in FIGS. 4A-4D, giving photoelectron peaks of Ag, W, O, and P elements. The Ag 3d gives two strong peaks at 367.48 and 373.57 eV due to $Ag^+$ species similar to those seen in AgW with a small shift to higher binding energies, proving the generation of a strong heterojunction between AgW and P that constitutes an amount made up of 13.8%. Additionally, the Ag nanoparticles are characterized by the two peaks at 369.87 and 375.38 eV, which are not detected in XRD due to their very low percentages (0.43%) compared to $Ag^+$. The quantity of $Ag^o$ was decreased compared to the AgW. Peaks attributed to $W^{6+}$ (36.01, 38.23, and 42.37 eV) are detected at greater binding energies than those observed for W in AgW (34.8, 36.8, and 40.2 eV). A remarkably high shift indicates the highly strong interaction between P and AgW due to the increased electron density. The O 1s XPS spectrum is convoluted into three peaks at 531.18 eV, 532.2 eV, and 533.02 eV attributed to Ag—O, W—O, and $H_2O$, respectively, with a higher shift due to higher binding energies compared to those observed in AgW (530.0 and 531.3 eV). The P 2p XPS spectrum shows a main peak at 134.3 eV attributed to P $2p_{3/2}$, which can be assigned to the P—O groups. From the results, the XPS and IR spectra recommend successfully incorporating phosphorus into the AgW material, with indicative signals to recognize the presence of newly prone functional groups.

Figure 5:
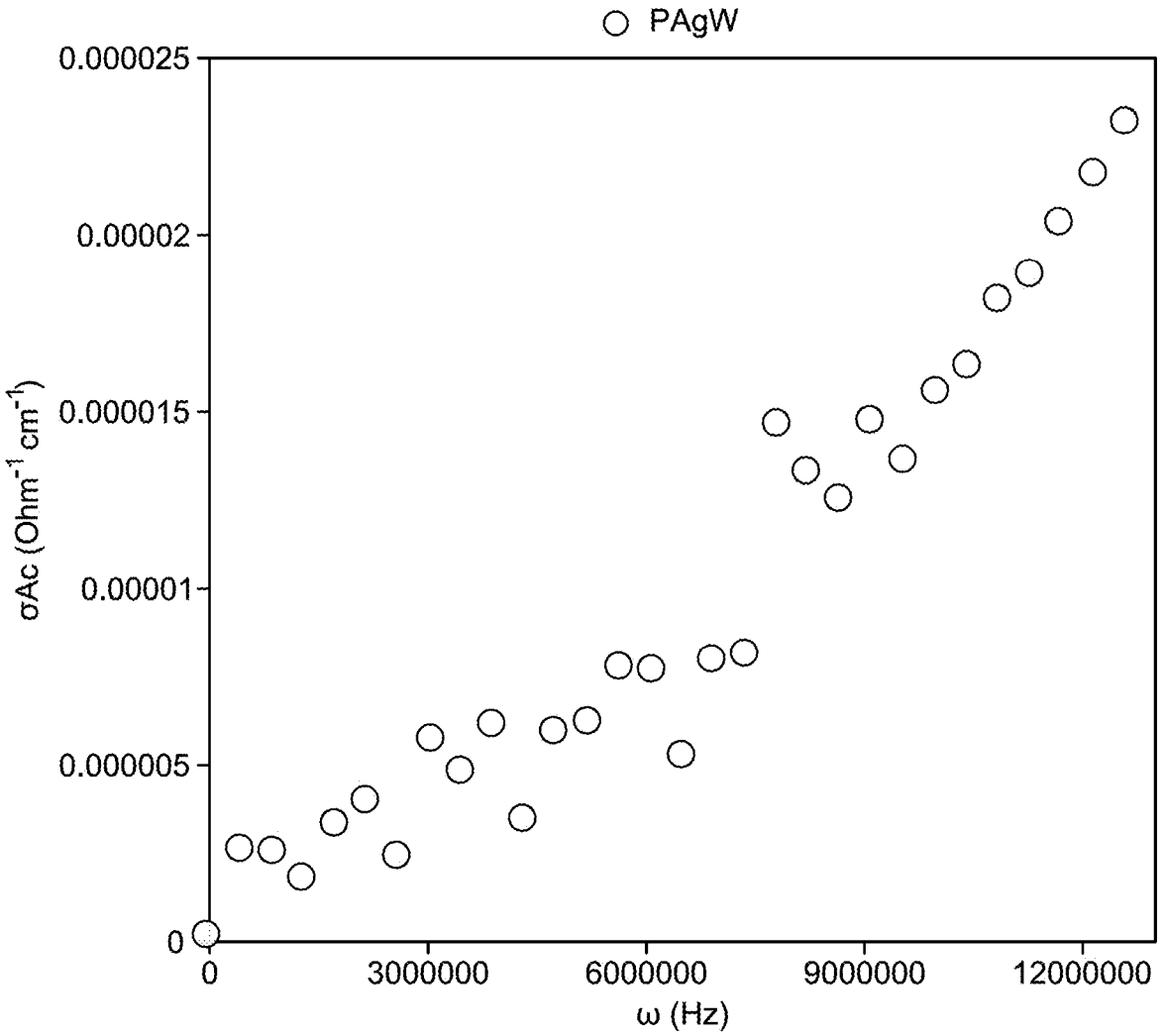
FIG. 5 is a graph depicting the dependence of AC conductivity on the frequency of P@AgW catalysts, according to certain embodiments.

The electrical conductivity ($\sigma_{Ac}$) of AgW and P-doped AgW samples as a function of frequency was measured and presented in FIG. 5 based on the following formula: $\sigma_{AC}=\varepsilon'\varepsilon_0\cdot\omega\cdot\tan\delta$. Where the angular frequency ($\omega$) is equivalent to $2\pi f$, f is the applied field frequency, $\varepsilon'$ is the dielectric constant, $\varepsilon_0$ is the permittivity of vacuum, and tan $\delta$ is the loss tangent. The frequency-dependent rise in electrical conductivity, as shown in FIG. 5, indicates that both materials displayed semiconducting behavior. The release of charge carriers bound to certain sites, the impulse force from the applied field, and the boost in movement and transfer of the liberated charge carriers between various sites might all contribute to the rise in conductivity values at elevated frequencies. These liberated charge carriers are beneficial for a material conducting activity with electrons. The mobility of electrons among different metal ions and these released charge carriers impacts a material's ability to conduct electricity. It was observed that the conductivity values of P-doped AgW sample decreased compared to undoped AgW at all frequencies (FIG. 5) P@AgW ($2.5\times10^{-6}$ inverse ohms per centimeter ($ohm^{-1}$ $cm^{-1}$) at 140 kilohertz (kHz))<AgW ($1.5\times10^{-5}$ $ohm^{-1}$ $cm^{-1}$ at 140 kHz). The reduction in conductivity after doping may be caused by the compensation of the oxygen vacancy-related states compared to that in pure AgW. Doping with various nonmetallic elements causes the formation of a defect barrier at the grain border, which hinders the charge carrier's ability to pass through the grain and raises its trapping states. Free carriers are eventually captured by trapping states and rendered stationary. The diffusion of n-type (phosphorous) in the bulk of AgW affected the conductivity, indicating the decreasing number of free carriers doping with n-type doped nanomaterial.

Voltametric experiments were made in a conventional three-electrode electrochemical system at ambient temperature (25° C.) employing an autolab PGSTAT204 coupled to software named Nova 1.11 for processing the data. AgW and P@AgW electrodes with an area of 0.6 $cm^2$ were used as working electrodes. These electrodes were meticulously created by putting PVDF and carbon black onto FTO conductive glass in a proportion of 85:10:5. The electrochemical cell was filled with a 1.0 M solution of acidified (0.5 M $H_2SO_4$) $CH_3OH$, with or without the previously positioned electrodes. All potentials were denoted to the saturated Ag/AgCl electrode, which served as the reference electrode, and a thin platinum electrode, which functioned as the counter electrode. Unless otherwise specified, cyclic consequence sweeps were employed between 0.8 V and 1.3 V at a 10 millivolts per second (mV $s^{-1}$) scan rate. The acidic aqueous solution recorded the amperometric I-t curves at 0.2 V for 600 s. Electrochemical impedance spectroscopy (EIS) evolutions were carried out on the device mentioned, utilizing 10 mV amplitudes in the 100 kHz-0.1 Hz frequency range.

Figure 6A:
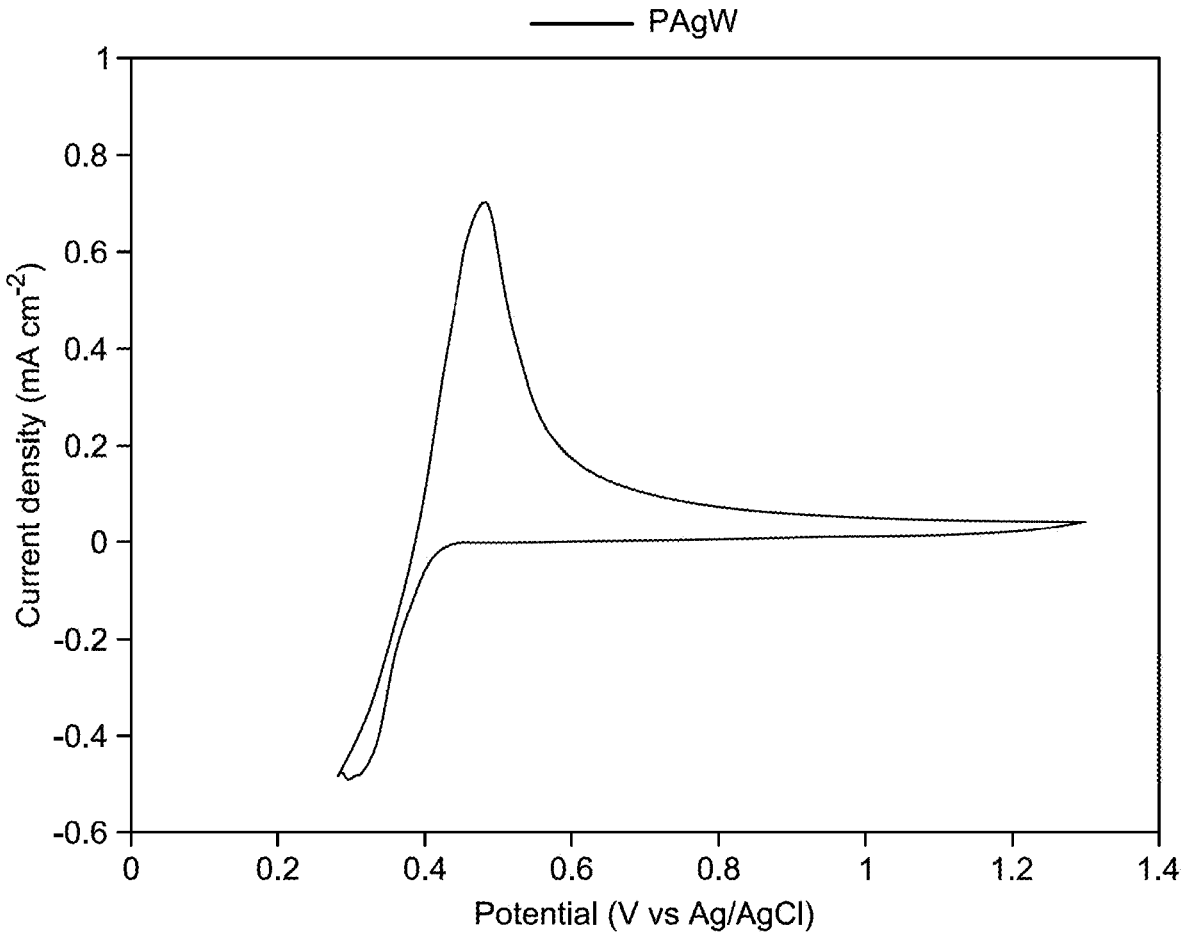
FIG. 6A shows typical cyclic voltammograms (CV) for P@AgW employing the 0.5 M $H_2SO_4$ electrolyte in the absence of MeOH, according to certain embodiments.
Figure 6B:
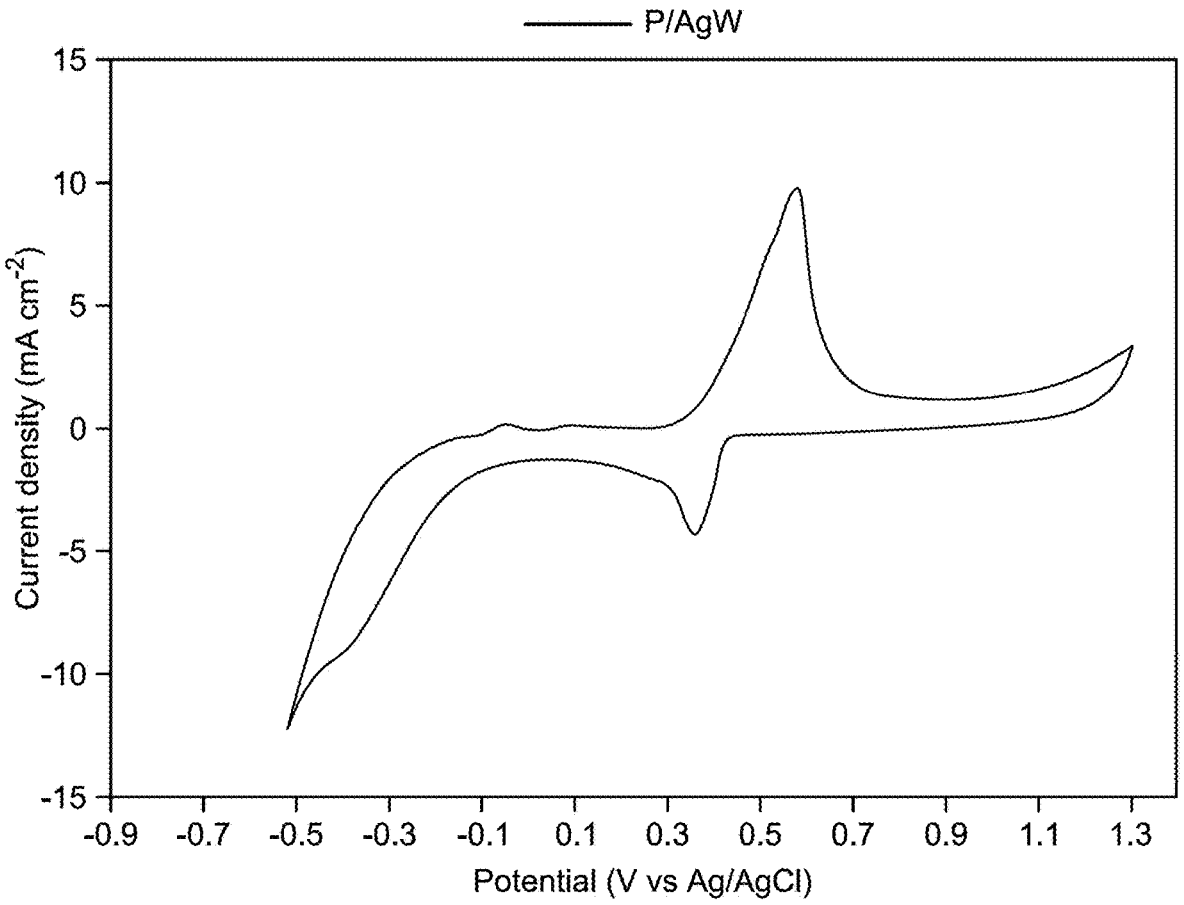
FIG. 6B shows a typical CV for the P@AgW employing the 0.5 M $H_2SO_4$ electrolyte in the presence of MeOH, according to certain embodiments.

FIGS. 6A-6B illustrate the typical Cyclic Voltammetry (CVs) for the P@AgW in both the presence and absence of MeOH while employing the 0.5 M $H_2SO_4$ electrolyte. Without MeOH, the P@AgW exhibits CV peaks at −0.32 V (−3.0 mA $cm^{-2}$) in the hydrogen area, while the AgW shows a backward peak at 0.31 V (−1.0 mA $cm^{-2}$) and two forward peaks at 0.5 V (0.9 mA $cm^{-2}$) and 0.09 V (0.9 mA $cm^{-2}$). In contrast to voltammograms with no methanol, those with methanol exhibit a dramatic increase in anodic current, indicating the catalytic oxidation of methanol at the surface of the modified electrode. The Methanol Oxidation Reaction (MOR) activity of AgW was assessed by performing CV scans from −0.9 to 1.3 V in a 1 M $H_2SO_4$+0.5 M $CH_3OH$ electrolyte solution using a three-electrode system at a scan rate of 10 mA $s^{-1}$, along with modified P@AgW electrocatalysts. An electrode made of carbon was employed as a counter electrode to prevent the impact of the Pt electrode on the MOR performance. The MOR onset potential of the AgW sample is as low as 0.3 V, with two obvious oxidation peaks at 0.5 V (forward, with 3 mA $cm^{-2}$ current density) and 0.3 V (backward, with 15 mA $cm^{-2}$). The former peak indicates a mass activity of 348 mA $g^{-1}$. The hydrogen potential deposition peak of the catalyst produces a high current density, approaching 32 mA cm 2 at −0.62 V and a methanol oxidation peak of 7 mA $cm^{-2}$ at 1.3 V. The P@AgW electrode exhibits an oxidation forward current density peak of 10 mA $cm^{-2}$ at 0.58 V comprised of 1172 mA $g^{-1}$ mass activity and a backward current density peak of 5 mA $cm^{-2}$ at 0.35 V. It also indicates the higher methanol oxidation at 1.3 V of 2.5 mA $cm^{-2}$ with a hydrogen potential peak at −0.5 V with a current density of 12 mA $cm^{-2}$.

Figure 7A:
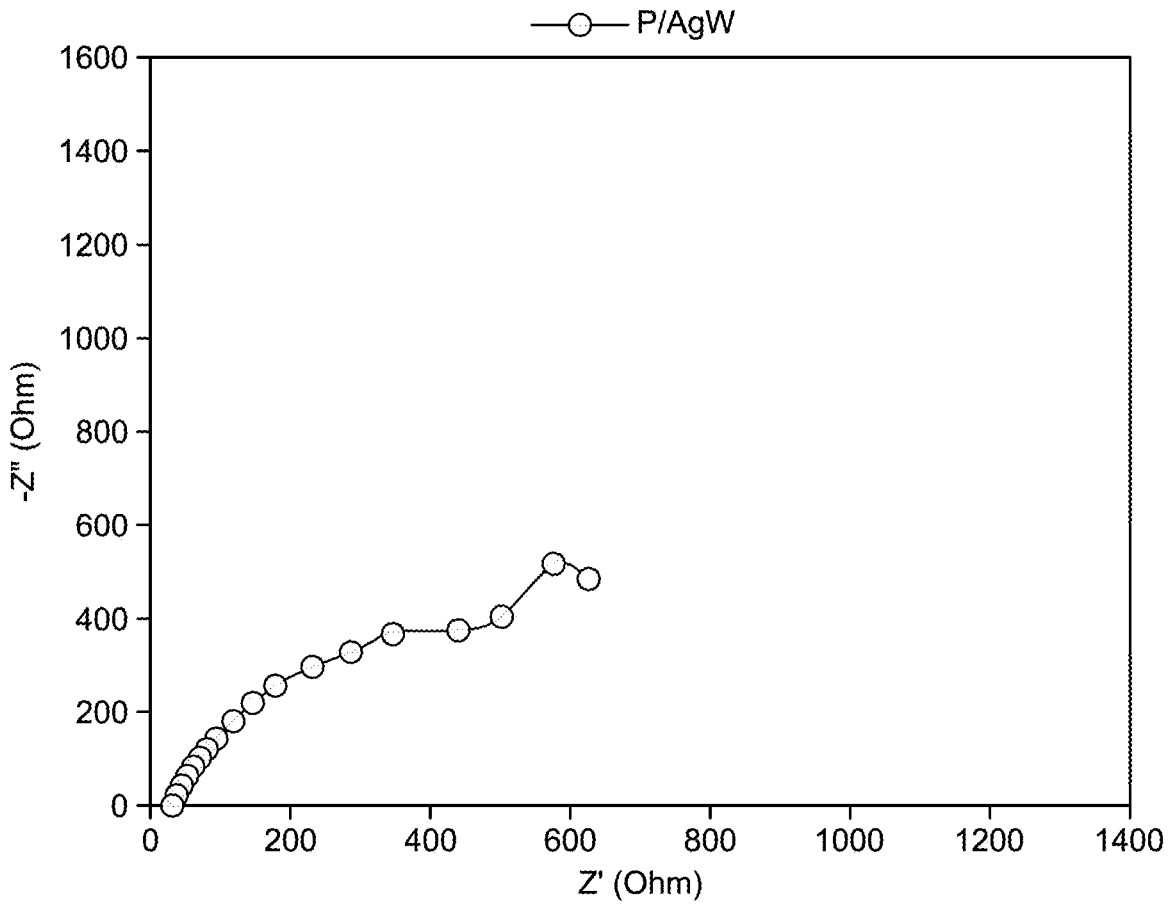
FIG. 7A shows Nyquist plot in methanol acidic medium (1 M methanol+0.5 M $H_2SO_4$) of AgW and P@AgW, according to certain embodiments.
Figure 7B:
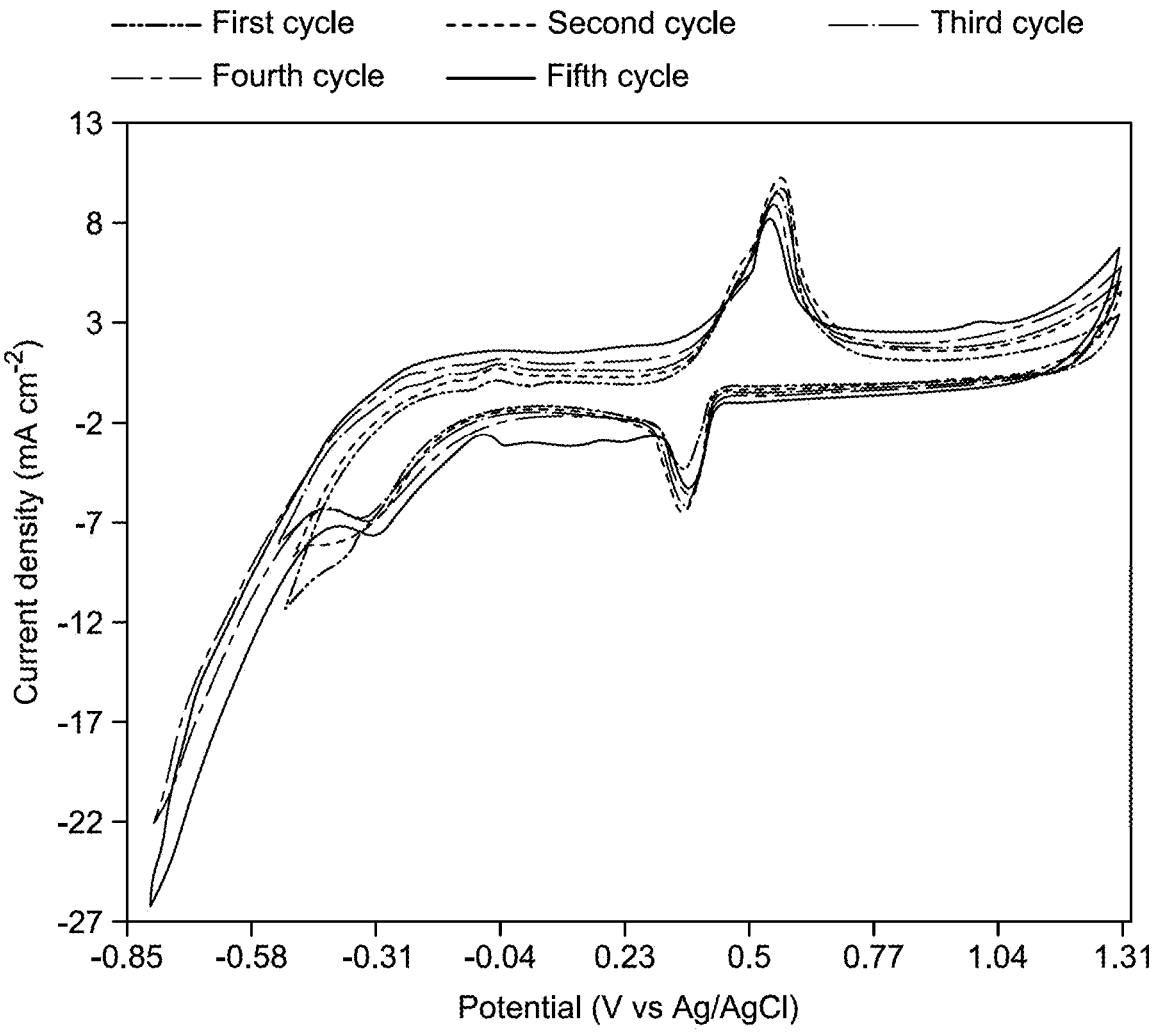
FIG. 7B shows the cyclic voltammograms of P@AgW performed for five cycles under similar conditions, according to certain embodiments.

FIG. 7A shows the electrochemical impedance (EIS) of P@AgW that is fitted with an equivalent circuit and includes a bulk solution resistance ($R_s$), a charge transfer resistance ($R_{ct}$), and a pseudocapacitive element ($C_{dl}$) from the $Ag^+/Ag$ redox process. Furthermore, the Warburg diffusion (W) impedance explains that the polarization that occurred was influenced by the kinetic and diffusion processes. The stability of the P@AgW electrocatalyst was assessed throughout five successive runs (FIG. 7B). Except for the fifth run, which exhibited a little shift of the forward peak into a positive potential while showing no change in the backward peak potential, the redox peaks show no change in potential. FIG. 7A also shows that the high oxidation current density, which peaks at 1.29 V and is equivalent to 6.5 mA $cm^{-2}$, was higher than in the first run. Despite exposing a small amount of $H_2$ adsorption peak in the first run that comprised 12 mA $cm^{-2}$ current density, this electrode displayed a current density of 26 mA $cm^{-2}$ in the fifth run, indicating its stability. This higher activity of P@AgW is also not only due to the decreased particle size and the highest electrochemical surface area but also to tuning the morphology to spherical structure, combining appreciable quantities of both α- and β-AgW which can offer additional active centers on their large side surface. More specifically, the β-AgW phase appears more active in activating MeOH oxidation on P@AgW since it represents a percentage of ~80% compared to AgW. This suggests that the highly active sites are the lattice spacings (005) and (004) of the latter phase, as depicted by HRTEM results. The electrocatalyst performance and stability is assessed with the chronoamperometric technique's assistance. For the P@AgW and the unmodified counterpart AgW, the standard current density vs. time dependence for MOR was determined at 0.2 V, and the finding was evident that P@AgW has a larger decay tolerance than AgW, reaching 5 mA $cm^{-2}$ after 600 s. AgW experienced a rapid fall in decay current density, close to 2 mA $cm^{-2}$, after the same period.

Numerous modifications and variations of the present disclosure are possible in light of the above teachings. It is therefore to be understood that within the scope of the appended claims, the invention may be practiced otherwise than as specifically described herein.

The invention claimed is:

1. A method for electrochemical oxidation of methanol, the method comprising:

applying a voltage to a solution comprising methanol in an electrochemical cell comprising a saturated Ag/AgCl reference electrode, a counter electrode and a working electrode at least partially coated with a catalyst composition comprising phosphorus-doped $Ag_2WO_4$ nanoparticles, wherein the amount of phosphorus present in the phosphorus-doped $Ag_2WO_4$ nanoparticles is in a range from 5 to 30% of the total weight of the phosphorus-doped $Ag_2WO_4$ nanoparticles, wherein a current density during the applying is greater than 5 mA·$cm^{-2}$ at an applied voltage of 0.58 V against the saturated Ag/AgCl reference electrode, wherein during the applying the methanol is oxidized to form carbon dioxide and hydrogen.

2. The method of claim 1, wherein the phosphorus-doped $Ag_2WO_4$ nanoparticles have α-$Ag_2WO_4$ and β-$Ag_2WO_4$ crystallites and the ratio of β-$Ag_2WO_4$:α-$Ag_2WO_4$ crystallites is in a range from 2:1 to 6:1.

3. The method of claim 2, wherein the phosphorus-doped $Ag_2WO_4$ nanoparticles have a ratio of β-$Ag_2WO_4$:α-$Ag_2WO_4$ crystallites in a range from 3:1 to 5:1.

4. The method of claim 3, wherein the phosphorus-doped $Ag_2WO_4$ nanoparticles have a ratio of β-$Ag_2WO_4$:α-$Ag_2WO_4$ crystallites in a range from 3.5:1 to 4.5:1.

5. The method of claim 1, wherein the amount of phosphorus present in the phosphorus-doped $Ag_2WO_4$ nanoparticles is in a range from 10 to 25% of the total weight of the phosphorus-doped $Ag_2WO_4$ nanoparticles.

6. The method of claim 5, wherein the amount of phosphorus present in the phosphorus-doped $Ag_2WO_4$ nanoparticles is in a range from 12 to 20% of the total weight of the phosphorus-doped $Ag_2WO_4$ nanoparticles.

7. The method of claim 1, wherein the current density during the applying is greater than 7 mA·$cm^{-2}$ at 0.58 V.

8. The method of claim 7, wherein the current density during the applying is greater than 9 mA·$cm^{-2}$ at 0.58 V.

9. The method of claim 1, wherein a mass activity during the applying is greater than 500 mA·$g^{-1}$.

10. The method of claim 9, wherein the mass activity during the applying is greater than 750 mA·$g^{-1}$.

11. The method of claim 10, wherein the mass activity during the applying is greater than 1000 mA·$g^{-1}$.

12. The method of claim 1, wherein a electro-chemical active surface area during the applying is greater than 6 mF·$cm^{-2}$.

13. The method of claim 12, wherein the electro-chemical active surface area during the applying is greater than 9 mF·$cm^{-2}$.

14. The method of claim 13, wherein the electro-chemical active surface area during the applying is greater than 12 mF·$cm^{-2}$.

15. The method of claim 1, wherein the phosphorus-doped $Ag_2WO_4$ nanoparticles have an electrical conductivity greater than $1.0\times10^{-6}\cdot\Omega^{-1}\cdot cm^{-1}$ at 140 kHz.

16. The method of claim 15, wherein the phosphorus-doped $Ag_2WO_4$ nanoparticles have an electrical conductivity greater than $1.5\times10^{-6}$ $\Omega^{-}\cdot cm^{-1}$ at 140 kHz.

17. The method of claim 16, wherein the phosphorus-doped $Ag_2WO_4$ nanoparticles have an electrical conductivity greater than $2.0\times10^{-6}$ $\Omega^{-}\cdot cm^{-1}$ at 140 kHz.

18. The method of claim 1, wherein the solution comprising methanol comprises a 1.0 M solution of methanol acidified with $H_2SO_4$ at a 0.5 M concentration.

19. The method of claim 1, wherein the surface area of the working electrode is in a range from 0.4 to 0.8 $cm^2$.

20. The method of claim 1, wherein the working electrode is at least partially coated with a coating comprising PVDF and carbon black.

* * * * *